US005476052A

United States Patent [19]

Kojima et al.

[11] Patent Number: 5,476,052

[45] Date of Patent: Dec. 19, 1995

[54] EXTENSION, FREE ARM AND AUXILIARY BEDS FOR OVERLOCK MACHINE

[75] Inventors: Shinji Kojima; Masanori Mizunuma; Koichi Nakayama, all of Utsunomiya, Japan

[73] Assignee: The Singer Company N.V., Curaco, Netherlands

[21] Appl. No.: 321,697

[22] Filed: Oct. 12, 1994

[51] Int. Cl.[6] ..... D05B 73/06; A47B 29/00; E05C 19/06

[52] U.S. Cl. ..... 112/260; 108/143; 292/87

[58] Field of Search ..... 112/258, 260, 112/217.1; 248/188.1; 108/59, 64, 90, 143; 292/80, 87, DIG. 38; 312/333.1, 334.1, 334.46, 334.44

[56] References Cited

U.S. PATENT DOCUMENTS

| | | | |
|---|---|---|---|
| 2,791,066 | 9/1955 | Budzinski | 108/143 X |
| 3,344,762 | 10/1967 | Szostak et al. | 112/260 |
| 3,923,347 | 12/1975 | Dean | 312/334.46 X |
| 4,058,072 | 11/1977 | Ishikawa et al. . | |
| 4,114,548 | 9/1978 | Kasahara et al. | 112/258 |
| 4,426,944 | 1/1984 | Bianchi | 112/260 |
| 4,565,142 | 1/1986 | McGann | 112/260 |
| 4,655,151 | 4/1987 | Alberti et al. | 112/260 X |

FOREIGN PATENT DOCUMENTS

| | | | |
|---|---|---|---|
| 824291 | 7/1949 | Germany | 112/260 |
| 5159218 | 5/1976 | Japan | 112/260 |

*Primary Examiner*—C. D. Crowder
*Assistant Examiner*—Ismael Izaguirre
*Attorney, Agent, or Firm*—McCormick, Paulding & Huber

[57] ABSTRACT

A bed structure for an overlock machine comprises a fixed bed formed by connecting an extension bed to a portion of the front side of a main bed, a substantially box-shaped free arm cover transversely slidably and removably disposed contiguously with a main frame beside a throat plate so as to cover a looper; and a substantially U-shaped auxiliary bed having a front portion, a side portion and a rear portion, disposed so as to surround all sides of of the free arm cover excluding one side of the free arm cover adjacent to the main frame with the front portion thereof inserted in a gap between the extension bed and the free arm cover and with the end surfaces of the lower wall and the lower side wall of the side portion thereof in contact with the side surfaces of the main frame and joined to the extension bed with a horizontal land portion formed in the surface of the front portion thereof fitted in a horizontal groove formed in the corresponding surface of the extension bed so as to be transversely movable relative to the extension bed.

2 Claims, 3 Drawing Sheets

EXTENSION, FREE ARM AND AUXILIARY BEDS FOR OVERLOCK MACHINE

BACKGROUND OF THE INVENTION

1. Field of the Invention

The present invention relates to a bed structure for a free arm type overlock machine.

2. Related Art

The overlock machine forms overlock sews by the cooperative operations of a vertically movable needle holding a needle thread, an upper looper holding an upper looper thread and operates across a workpiece feed direction, and a lower looper holding a lower looper thread. The free arm type overlock machine, in general, has replaceable accessories including a free arm cover and an auxiliary bed. Only the free arm cover is used for sewing cylindrical workpieces, such as cuffs and the bottom edges of pants legs, and pouches. The auxiliary bed is used, in combination with the free arm cover, for sewing ordinary fiat workpieces. Although the free arm type overlock machine is well adapted to sew cylindrical workpieces and pouches, it is difficult to sew fiat workpieces because the free arm has a narrow supporting area. Therefore, the auxiliary bed is attached to the free arm to provide a wide supporting area for sewing fiat workpieces. The free arm cover of the free arm type overlock machine must be removed in threading the lower looper. If the auxiliary bed is attached to the free arm, the auxiliary bed must be removed before removing the free arm cover, which requires additional work for threading the lower looper.

SUMMARY OF THE INVENTION

The present invention has been made in view of the aforesaid technical problems in the prior art.

A bed structure for an overlock machine in a first aspect of the present invention comprises: a fixed bed formed by connecting an extension bed to a portion of the front side of a main bed; a substantially box-shaped flee-arm cover transversely slidably and removably disposed contiguously with on one end of a main frame beside a throat plate so as to cover a looper; and a substantially U-shaped auxiliary bed having a front portion, a side portion and a rear portion, disposed so as to surround all the sides of the free arm cover excluding a side of the free arm cover adjacent to the main frame with the front portion thereof inserted in a gap between the extension bed and the free arm cover and with the end surfaces of the lower wall and the lower side wall of the side portion thereof in contact with the side surfaces of the main frame, and joined to the extension bed with a horizontal land portion formed in the surface of the front portion thereof fitted in a horizontal groove formed in the corresponding surface of the extension bed so as to be transversely movable relative to the extension bed and so as to form a workpiece supporting surface together with the respective upper surfaces of the extension bed and the free arm cover.

A bed structure for an overlock machine in a second aspect of the present invention is characterized in that the free arm cover of the bed structure in the first aspect is provided with an opening in one side wall thereof, a catching portion is formed on the edge of the opening, an opening is formed in the lower wall of the side portion of the auxiliary bed, and an elastically bendable locking finger provided at its extremity with a hook is projected from the side portion of the auxiliary bed so as to extend above the opening formed in the lower wall of the side portion of the auxiliary bed so that the hook of the locking finger is caught by the catching portion when the auxiliary bed is joined to the free arm cover.

The free arm cover can be slid transversely in one direction into place and slid transversely in the opposite direction to remove the same. The auxiliary bed can be put in place by transversely inserting the front portion thereof in the space between the extension bed and the free arm cover so that the horizontal landsportion thereof slides along the horizontal groove of the extension bed and can be removed by transversely extracting the front portion from the space between the auxiliary bed and the free arm cover. When the combination of the free arm cover and the auxiliary bed is attached to the fixed bed, the front portion of the auxiliary bed extends between the extension bed and the free arm cover, the horizontal land portion of the auxiliary bed is fitted in the horizontal groove of the extension bed, and the lower wall and another side wall of the side portion are fixed to the side surfaces of the main frame and, therefore, the combination of the free arm cover and the auxiliary bed can firmly be joined to the main frame and the respective upper surfaces of the extension bed, the auxiliary bed and the free arm cover form a wide fiat workpiece supporting surface.

The combination of the free arm cover and the auxiliary bed can transversely be moved in one direction to put the same in place and in the opposite direction to remove the same. Thus the free arm cover and the auxiliary bed can simultaneously be removed to thread the looper.

When the auxiliary bed and the free arm cover are joined together, the hook of the elastically bendable locking finger of the auxiliary bed is caught by the catching portion of the free arm cover to join the auxiliary bed and the free arm cover firmly together. Therefore, the free arm cover and the auxiliary bed can easily be handled in a single unit. When disconnecting the auxiliary bed from the free arm cover, the locking finger extending above the opening is bent upward to disengage the hook from the catching portion of the free arm cover.

Since the free arm cover and the auxiliary bed can be removed either separately or simultaneously, the threading of the lower looper can easily be carried out even if both the free arm cover and the auxiliary bed are joined to the main frame.

Since the hook of the locking finger extending above the opening of the auxiliary bed is caught by the catching portion formed on the edge of the opening of the free arm cover in the lower portion of the free arm cover, the locking finger will not interfere with a workpiece during sewing operation. Since the locking finger is formed integrally with the auxiliary bed by molding a synthetic resin, the auxiliary bed does not need any additional parts for locking the same on the free arm cover and can easily be formed at a reduced cost.

BRIEF DESCRIPTION OF THE DRAWINGS

FIG. 5 is a perspective view of assistance in explaining the function of the present invention; and.

PREFERRED EMBODIMENTS OF THE PRESENT INVENTION

Figure 1:
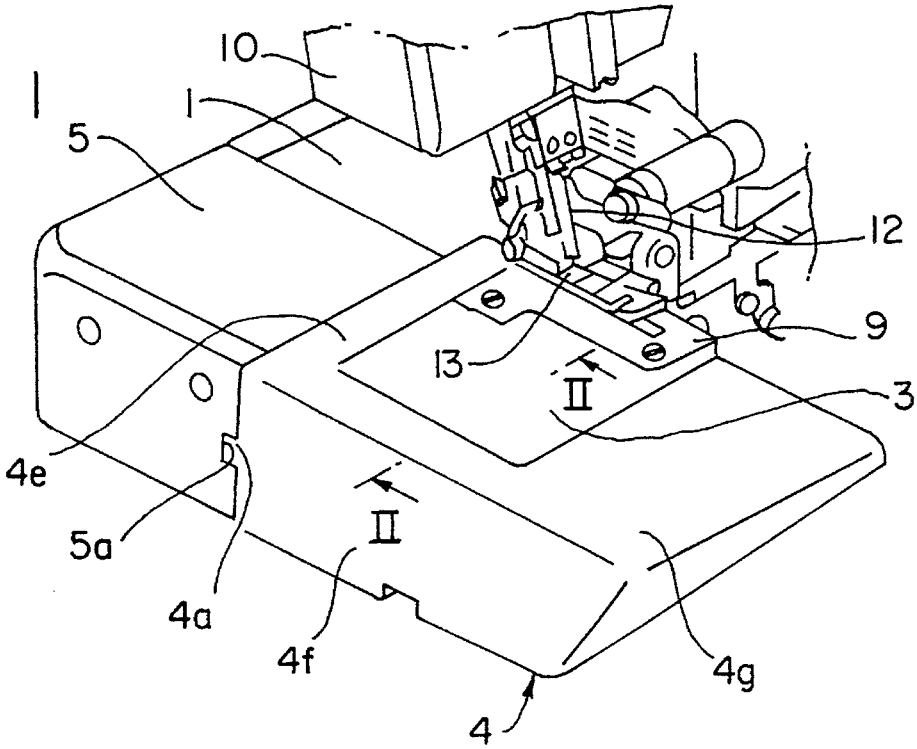
FIG. 1 is a perspective view of a bed structure in a preferred embodiment according to the present invention for an overlock machine.

Referring to FIGS. 1 to 6 showing a bed structure in a preferred embodiment according to the present invention, an extension bed 5, a throat plate 9 and an arm 10 are fixedly mounted on a main bed 1. The main bed 1 and the extension bed 5 constitute a fixed bed. The extension bed 5 is disposed in one side of the front portion, i.e., the left-hand front portion in FIG. 1, of the overlock machine. A needle 12 and a presser foot 13 are supported on the arm 10. A free arm cover 3 for covering a lower looper 8 shown in FIG. 8 is detachably mounted on a main frame 2 on one side of the throat plate 9, and a substantially U-shaped auxiliary bed 4 is detachably joined to the free arm cover 3 so as to surround the latter. The respective upper surfaces of the free arm cover 3, the auxiliary bed 4, the extension bed 5 and the throat plate 9 form a workpiece supporting surface for supporting a workpiece, not shown.

Figure 2:
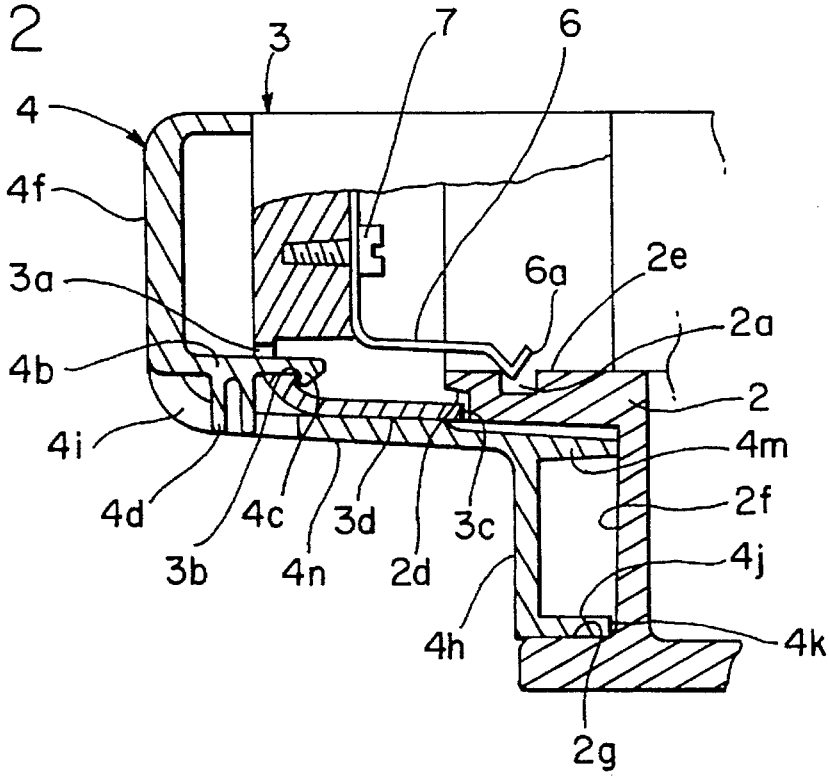
FIG. 2 is a sectional view taken on line II—II in FIG. 1.
Figure 6:
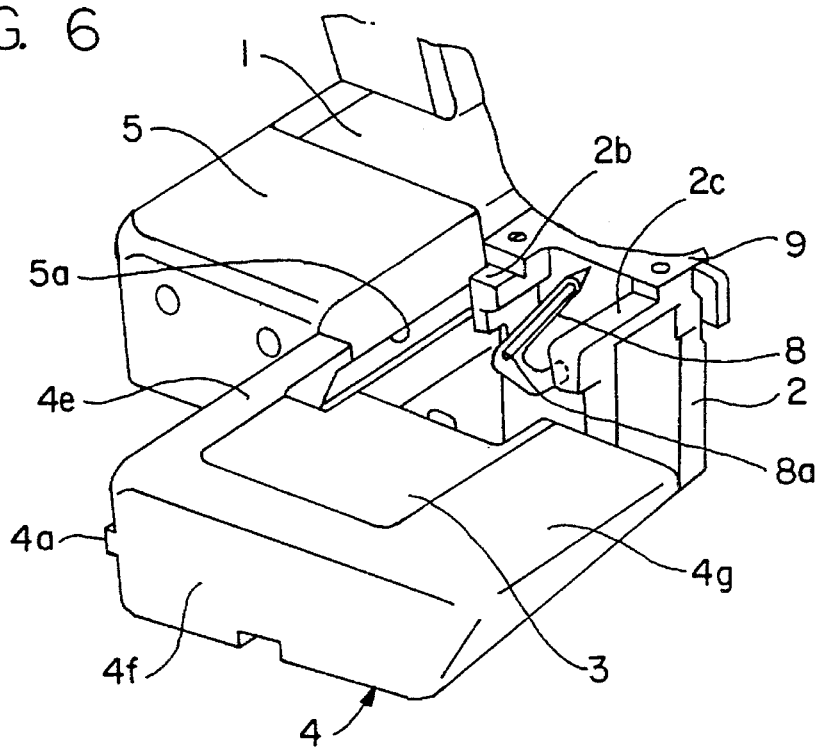
FIG. 6 is a perspective view of assistance in explaining the function of the present invention.

The free arm cover 3 has the shape of a box or a square cylinder and is detachably attached to the main frame 2 formed integrally with the main bed 1 with its opposite upper corners seated on horizontal guide rails **2*b* and 2*c* of the main frame 2 shown in FIG. 6, with its lower side surface 3*c* in contact with one vertical end surface 2*d* of the main frame 2 as shown in FIG. 2, and with a bend 6*a* formed on a plate spring 6 fastened to the inner bottom surface thereof with a screw 7 in elastic engagement with a recess 2*a* formed in a horizontal step 2*e* of the main frame 2. When removing the free arm cover 3 from the main frame 2, the free arm cover 3 is pulled transversely away from the main frame to disengage the bend 6*a* of the plate spring 6 from the recess 2*a* and to move the free arm cover 3 horizontally away from the main frame 2 along the horizontal guide rails 2*b* and 2*c* of the main frame. When the free arm cover 3 is removed from the main frame 2, the space above the lower looper 8 is opened to enable the looper 8 provided with an eye 8*a*** to be threaded.

The auxiliary bed 4 has a front portion **4*e*, a side portion 4*f* and a rear portion 4*g* forming a substantially U-shaped upper surface for supporting a workpiece. The auxiliary bed 4 can horizontally be moved toward and away from the main frame 2 to join the same to and to separate the same from the main frame 2. The front portion 4*e* of the auxiliary bed 4 has a width corresponding to the width of a gap between the front surface of the free arm cover 3 and the rear surface of the extension bed 5. As shown in FIGS. 1 and 6, a horizontal horizontal groove 5*a* is formed in the rear surface of the extension bed 5 so as to open in the side surface of the extension bed 5, and a horizontal horizontal land portion 4*a* that fits the horizontal groove 5*a* is formed on the front surface of the front portion 4*e* of the auxiliary bed 4. The front portion 4*e* of the auxiliary bed 4 is inserted in the gap between the front surface of the free arm cover 3 and the rear surface of the extension bed 5 with the horizontal land portion 4*a* thereof fitted in the horizontal groove 5*a* of the extension bed 5. Therefore, auxiliary bed 4 is restrained from longitudinal movement by the free arm cover 3 and the extension bed 5 and from vertical movement by the engagement of the horizontal land portion 4*a* thereof and the horizontal groove 5*a* of the extension bed 5, while the auxiliary bed 4 can be moved transversely. As shown in FIG. 2, a support wall 4*h* extends downward and an extension wall 4*m* extends horizontally toward the main frame 2 from the extremity of a lower wall 4*n* of the side portion 4*f* of the auxiliary bed 4, and a projection 4*j* projects horizontally toward the main frame 2 from the lower end of the support wall 4*h*. The lower surface of the projection 4*j* can be brought into contact with the horizontal upper surface of a guide step 2*g* of the main frame 2, and the end surface 4*k* of the projection 4*j* and the end surface of the extension wall 4*m* can be brought into contact with the side surface of a vertical wall 2*f* of the main frame 2. An opening 4*i* is formed in the lower wall 4*n* of the side portion 4*f* of the auxiliary bed 4, and a locking finger 4*b* provided at its extremity with a hook 4*c* is formed integrally with the auxiliary bed 4 so as to extend horizontally toward the main frame 2 and above the opening 4*i* from the upper edge of the opening 4*i*. The auxiliary bed 4 and the locking finger 4*b* are formed of a synthetic resin and the locking finger 4*b* is elastically bendable. A protrusion 4*d* is formed on the lower surface of the locking finger 4*b* substantially at the middle of the locking finger 4*b* so as to correspond substantially to the center of the opening 4*i*. The lower end of the protrusion 4*d* is substantially flush with the lower surface of the auxiliary bed 4. An elastic locking finger formed of a material for springs may be attached to the auxiliary bed 4 instead of forming the locking arm 4*b* integrally with the auxiliary bed 4**.

Referring again to FIG. 2, an opening **3*a* is formed in the end wall of the free arm cover 3, and a catching portion 3*b* is formed on the lower edge of the opening 3*a*. When joining the auxiliary bed 4 to the main frame 2, the locking finger 4*b* of the auxiliary bed 4 enters the free arm cover 3 through the opening 3*a*, and the hook 4*c* of the locking arm 4*b* is caught by the catching portion 3*b* formed on the lower edge of the opening 3*a*. When engaging the hook 4*c* and the catching portion 3*b* or disengaging the hook 4*c* from the catching portion 3*b*, the auxiliary bed 4 is moved transversely relative to the free arm cover 3 with the lower surface of the lower wall 3*d* of the free arm cover 3 in sliding contact with the upper surface of the lower wall 4*n* of the side portion 4*f* of the auxiliary bed 4. Thus, the auxiliary bed 4 is joined firmly to the free arm cover 3 joined to the main frame 2**.

When joining the free arm cover 3 to the main frame 2 integral with the main bed 1, the free arm cover 3 is put on the horizontal guide rails **2*b* and 2*c* of the main frame 2 so that the opposite upper corners of the free arm cover 3 are seated on the horizontal guide rails 2*b* and 2*c*, respectively, as shown in FIG. 6, the lower side surface 3*c* of the lower wall 3*d* is brought into contact with the vertical end surface 2*d* of the main frame 2, and the bend 6*a* of the plate spring 6 is brought into elastic engagement with the recess 2*a* of the main frame 2*a* as shown in FIG. 2**.

When joining the auxiliary bed 4 to the main frame 2, the front portion **4*e* is inserted in the gap between the front surface of the free arm cover 3 and the rear surface of the extension bed 5 with the horizontal land portion 4*a* of the auxiliary bed 4 aligned with the horizontal groove 5*a* of the extension bed 5, the lower surface of the projection 4*j* of the support wall 4*h* is brought into contact with the upper surface the guide step 2*g* of the main frame 2, and the end surface 4*k* of the projection 4*j* and the end surface of the extension wall 4*m* are brought into contact with the vertical wall 2*f* of the main frame 2. In the meantime, the locking finger 4***b* of the auxiliary bed 4 is bent elastically upward, enters the free arm cover 3 through the opening 3*a* and the hook 4*c* is caught by the catching portion 3*b* formed on the lower edge of the opening 3*a* when the locking finger 4*b* restores its normal shape elastically.

After the auxiliary bed 4 has firmly been joined to the extension bed 5 and the free arm cover 3, a fiat workpiece is placed for sewing on a wide, fiat, workpiece supporting surface formed by the respective upper surfaces of the free arm cover 3, the substantially U-shaped auxiliary bed 4 surrounding all the sides of the free arm cover 3 excluding the side on the side of the main frame 2, and the extension bed 5. The wide, fiat, workpiece supporting surface ensures stable sewing operation.

Figure 3:
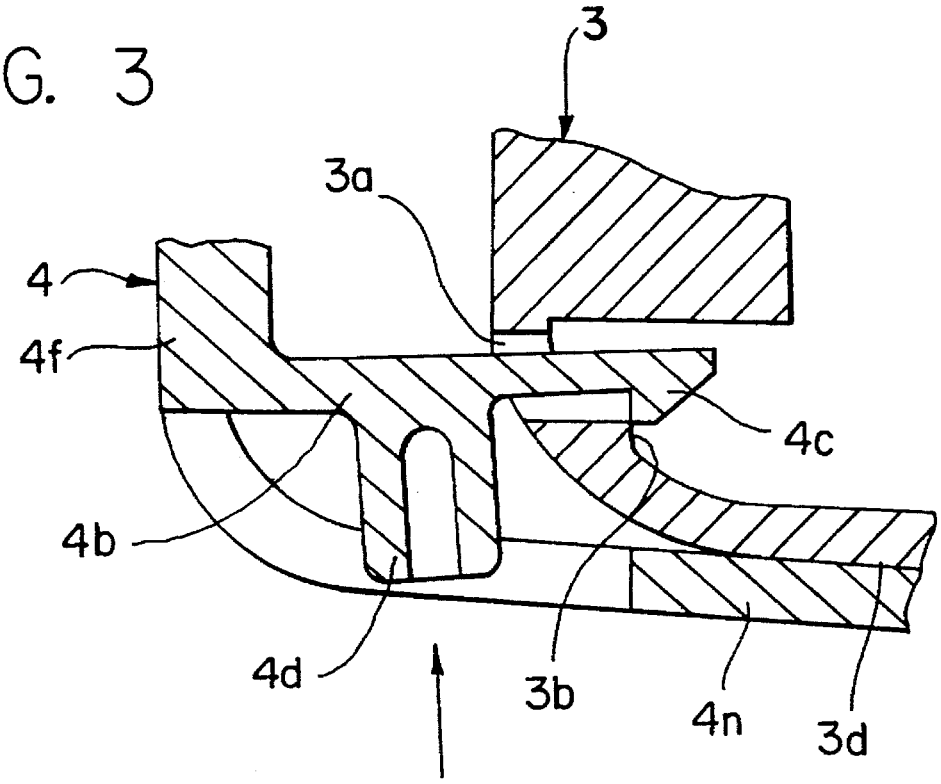
FIG. 3 is a fragmentary sectional view of assistance in explaining the function of a locking finger included in an auxiliary bed included in the bed structure of FIG. 1.
Figure 4:
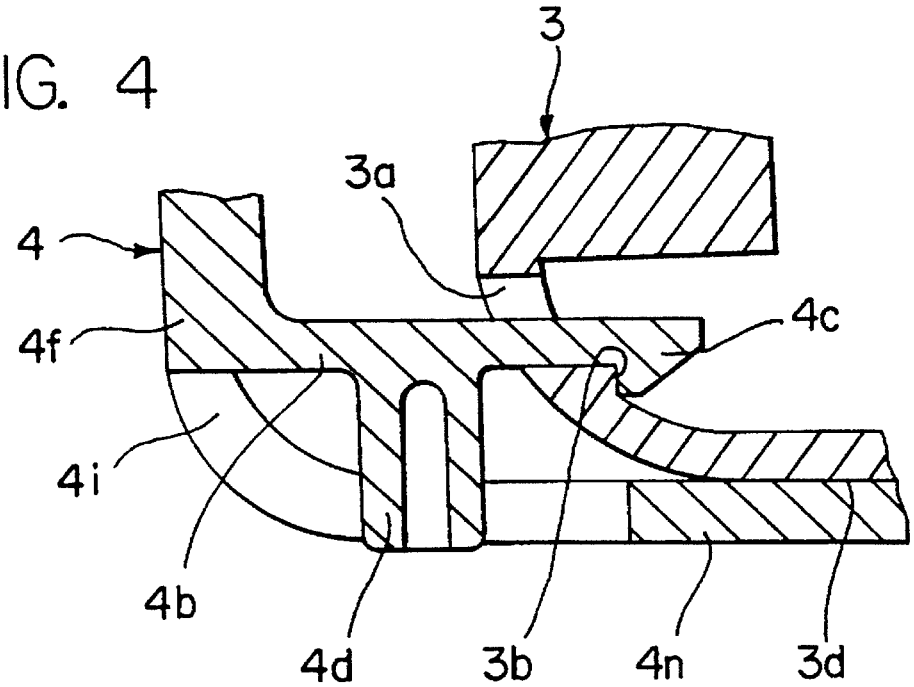
FIG. 4 is a fragmentary sectional view of assistance in explaining the function of the locking finger.
Figure 5:
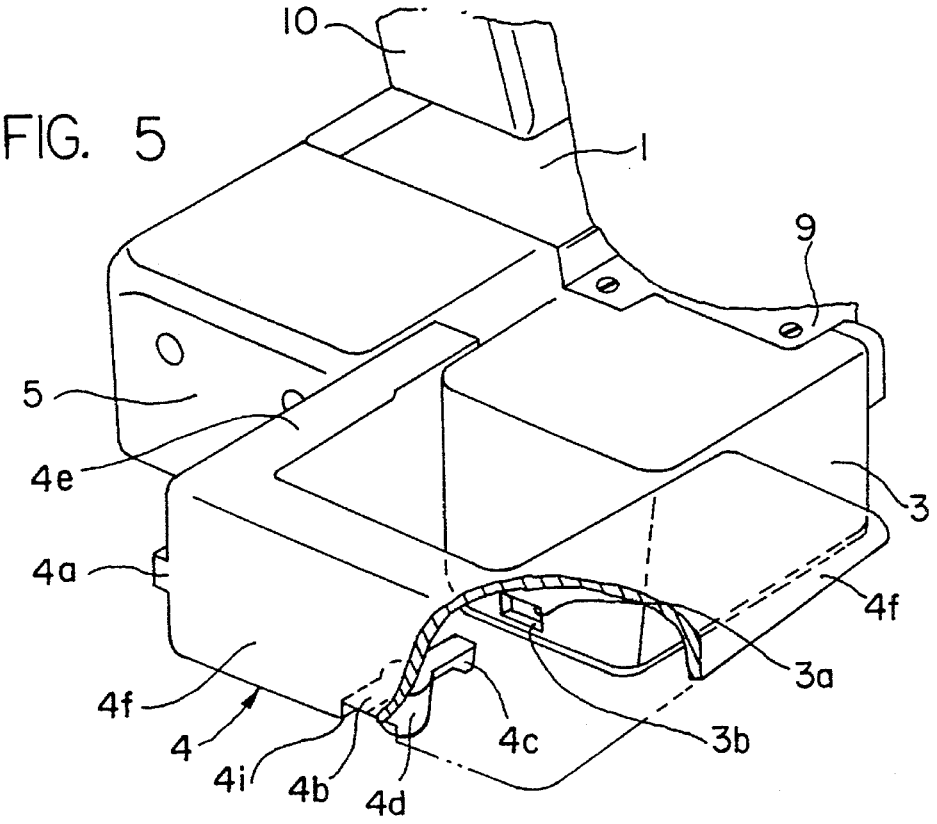

When removing the auxiliary bed 4, the protrusion 4*d* of the locking finger 4*b* is pushed in the direction indicated by the arrow in FIG. 3 to disengage the hook 4*c* from the catching portion 3*b*, and then the auxiliary bed 4 is moved horizontally away from the main frame 2 so that the horizontal land portion 4*a* slides along the horizontal groove 5*a* and the projection 4*j* slides along the upper surface of the guide step 2*g*. With the auxiliary bed 4 removed and the free arm cover 3 joined to the main frame 2, a cylindrical workpiece, such as a cuff or the bottom of the leg of a pair of pants, or a pouch is put on the free arm cover 3 for sewing.

When removing the free arm cover 3, the free arm cover 3 is pulled horizontally away from the main frame 2 to disengage the bend 6*a* of the plate spring 6 from the recess 2*a* forcibly, and then the free arm cover 3 is moved horizontally along the horizontal guide rails 2*b* and 2*c*. When the free arm cover 3 is removed, the space over the lower looper 8 is opened to enable the threading of the lower looper 8. When the free arm cover 3 is pulled horizontally away from the main frame 2 in a state where the free arm cover 3 and the auxiliary bed 4 are joined to the main frame 2 and the extension bed 5, the bend 6*a* of the plate spring 6 is disengaged from the recess 2*a* of the main frame 2, and the free arm cover 3 can be removed together with the auxiliary bed 4 in the same manner as that in which only the free arm cover 3 is removed. It is also possible to join the free arm cover 3 to the main frame 2 and the extension bed 5 after joining together the free arm cover 3 and the auxiliary bed 4. The horizontal land portion 4*a* and the horizontal groove 5*a* may be interchanged for the same effect.

What is claimed is:

1. A bed structure for an overlock machine, comprising:

a fixed bed including a main bed having a front side defined with respect to a feed direction in which a workpiece is fed to be sewn by the overlock machine, and an extension bed having an upper surface, said extension bed being connected to a portion of the front side of the main bed;

a main frame having a front end defined with respect to the feed direction;

a substantially box-shaped free arm cover having an upper surface, said free arm cover being transversely slidably and removably disposed beside a throat plate with one side of the free arm cover contiguous with the front end of the main frame so as to cover a looper; and a substantially U-shaped auxiliary bed including a front portion, a side portion having a lower wall and a lower support wall extending therefrom, and a rear portion, said auxiliary bed disposed so as to surround all sides of the free arm cover, excluding the side of the free arm cover contiguous with the front end of the main frame, with the front portion of the auxiliary bed inserted in a gap between the extension bed and the free arm cover and with the lower wall and the lower support wall of the side portion in contact with the front end of the main frame, said auxiliary bed being joined to the extension bed with a horizontal land portion formed in the surface of the front portion of the auxiliary bed fitted in a horizontal groove formed in the corresponding surface of the extension bed so as to be transversely movable relative to the extension bed and so as to form a workpiece supporting surface together with the upper surfaces of the extension bed and the free arm cover.

2. A bed structure for an overlock machine according to claim 1, wherein the free arm cover is provided with an opening in one side wall thereof, a catching portion is formed on the edge of the opening, an opening is formed in the lower wall of the side portion of the auxiliary bed, and an elastically bendable locking finger provided at its extremity with a hook projects from the side portion of the auxiliary bed so as to extend above the opening formed in the lower wall of the side portion of the auxiliary bed so that the hook of the locking finger is caught by the catching portion when the auxiliary bed is joined to the free arm cover.

* * * * *